US011247249B2

(12) United States Patent
Gao et al.

(10) Patent No.: US 11,247,249 B2
(45) Date of Patent: Feb. 15, 2022

(54) METHOD FOR REMOVING OXIDE MATERIALS FROM A CRACK

(71) Applicant: General Electric Company, Schenectady, NY (US)

(72) Inventors: Yibo Gao, Shanghai (CN); Hong Zhou, Shanghai (CN); Liming Zhang, Greer, SC (US); Yong Liu, Shanghai (CN); Yingna Wu, Shanghai (CN); Jianping Wu, Shanghai (CN)

(73) Assignee: General Electric Company, Schenectady, NY (US)

( * ) Notice: Subject to any disclaimer, the term of this patent is extended or adjusted under 35 U.S.C. 154(b) by 110 days.

(21) Appl. No.: 16/606,545

(22) PCT Filed: Apr. 18, 2017

(86) PCT No.: PCT/CN2017/080891

§ 371 (c)(1),
(2) Date: Oct. 18, 2019

(87) PCT Pub. No.: WO2018/191861

PCT Pub. Date: Oct. 25, 2018

(65) Prior Publication Data

US 2021/0115571 A1 Apr. 22, 2021

(51) Int. Cl.
*B08B 3/10* (2006.01)
*B08B 7/00* (2006.01)
(Continued)

(52) U.S. Cl.
CPC ..... *B08B 7/0042* (2013.01); *B08B 3/08* (2013.01); *B08B 3/12* (2013.01); *B08B 7/04* (2013.01);
(Continued)

(58) Field of Classification Search
None
See application file for complete search history.

(56) References Cited

U.S. PATENT DOCUMENTS 4,317,685 A * 3/1982 Ahuja ..... C23G 1/20 134/2
6,878,215 B1 4/2005 Zimmerman, Jr.
(Continued)

FOREIGN PATENT DOCUMENTS

CN 1702196 A 11/2005
CN 102418110 A 4/2012
(Continued)

OTHER PUBLICATIONS

International Search Report of the International Searching Authority for PCT/CN2017/080891 dated Jan. 25, 2018.

*Primary Examiner* — Mikhail Kornakov
*Assistant Examiner* — Ryan L Coleman
(74) *Attorney, Agent, or Firm* — Fletcher Yoder, P.C.

(57) ABSTRACT

A method for removing oxide materials from a crack of a metallic workpiece comprises: infiltrating an alkali solution into the crack in a pressurized atmosphere or an ultrasonic environment; applying an energy to the crack to react the oxide materials with the alkali solution and form a resultant material; and rinsing the resultant material with an acid solution to remove the resultant material from the crack. The method is easier to penetrate into the inside of the cracks, in particular suitable for cleaning narrow and deep cracks.

15 Claims, 1 Drawing Sheet

(51) Int. Cl.

| | |
|---|---|
| ***B08B 3/08*** | (2006.01) |
| ***B08B 3/12*** | (2006.01) |
| ***B08B 7/04*** | (2006.01) |
| ***C23G 5/00*** | (2006.01) |
| ***F01D 25/00*** | (2006.01) |

(52) U.S. Cl.
CPC ..... *C23G 5/00* (2013.01); *F01D 25/002* (2013.01); *B08B 2203/007* (2013.01)

(56) References Cited

U.S. PATENT DOCUMENTS

| | | | | |
|---|---|---|---|---|
| 2007/0125459 | A1* | 6/2007 | Gupta | C23G 1/00 148/535 |
| 2007/0170150 | A1* | 7/2007 | Bostanjoglo | C23G 1/00 216/62 |
| 2009/0065023 | A1* | 3/2009 | Rao | B08B 3/12 134/1 |
| 2010/0326466 | A1* | 12/2010 | Kawakami | C23F 1/44 134/3 |
| 2011/0168679 | A1* | 7/2011 | Qi | F01D 5/005 219/75 |
| 2018/0250762 | A1* | 9/2018 | Yan | B08B 7/0042 |

FOREIGN PATENT DOCUMENTS

| | | | |
|---|---|---|---|
| CN | 105586603 | A | 5/2016 |
| JP | S5168436 | A | 6/1976 |
| JP | S59229477 | A | 12/1984 |
| JP | 2015001163 | A | 1/2015 |

* cited by examiner

METHOD FOR REMOVING OXIDE MATERIALS FROM A CRACK

BACKGROUND

The present disclosure generally relates to methods for removing oxide materials from a crack of a metallic workpiece.

Metallic workpieces are often used in industrial environments. Because of the capability of withstanding a variety of extreme operating conditions, alloys comprising, e.g., aluminum, titanium and chromium are often used, for example, to make gas turbine engine components and other industrial parts.

Gas turbine engines are often subjected to repeated thermal cycling during operations. Cracks may generate in gas turbine engine components, such as turbine blade trailing edge. Under the oxidizing conditions, which often include temperatures in a range of about 760° C. to 1150° C., various oxide materials (mainly thermally-grown oxides) are formed on and within the cracks. When the gas turbine engine components are overhauled, they need to be repaired by brazing or other procedures. Oxide materials on and within the cracks are undesirable for repair service because the oxide materials, such as aluminum oxide, chromium oxide, cobalt oxide, and nickel oxide, prevent wetting of the alloy surface by the braze material. Therefore, during a local repair process of a metallic workpiece, the oxide materials in the cracks need to be removed from the cracks. However, the cleaning of the cracks is quite difficult because of the random growth and narrow boundary of the cracks.

A conventional method for cleaning the oxide materials from the cracks is known as fluoride ion cleaning (FIC), which is a high temperature gas-phase treatment using hydrogen fluoride and hydrogen gas. The equipment used in the FIC method is expensive and the hydrogen fluoride used is hazardous. To avoid the drawbacks of the FIC method, an alternative method comprises contacting the oxide materials with a slurry composition to react and form a resultant material, and rinsing the resultant material. However, it is difficult to apply the slurry composition into narrow cracks because of poor flowability of the slurry composition. So usually the oxide materials may not be removed completely, especially for cracks with narrow boundary and long depth. Therefore, it is desirable to develop a more effective method for cleaning oxide materials from cracks of metallic workpieces.

BRIEF DESCRIPTION

One aspect of the present disclosure provides a method for removing oxide materials from a crack of a metallic workpiece. The method comprises: infiltrating an alkali solution into the crack in a pressurized atmosphere or an ultrasonic environment; applying an energy to the crack to react the oxide materials with the alkali solution and form a resultant material; and rinsing the resultant material with an acid solution to remove the resultant material from the crack.

BRIEF DESCRIPTION OF THE DRAWING

The above and other aspects, features, and advantages of the present disclosure will become more apparent in light of the subsequent detailed description when taken in conjunction with the accompanying drawings in which.

DETAILED DESCRIPTION

Figure 1:
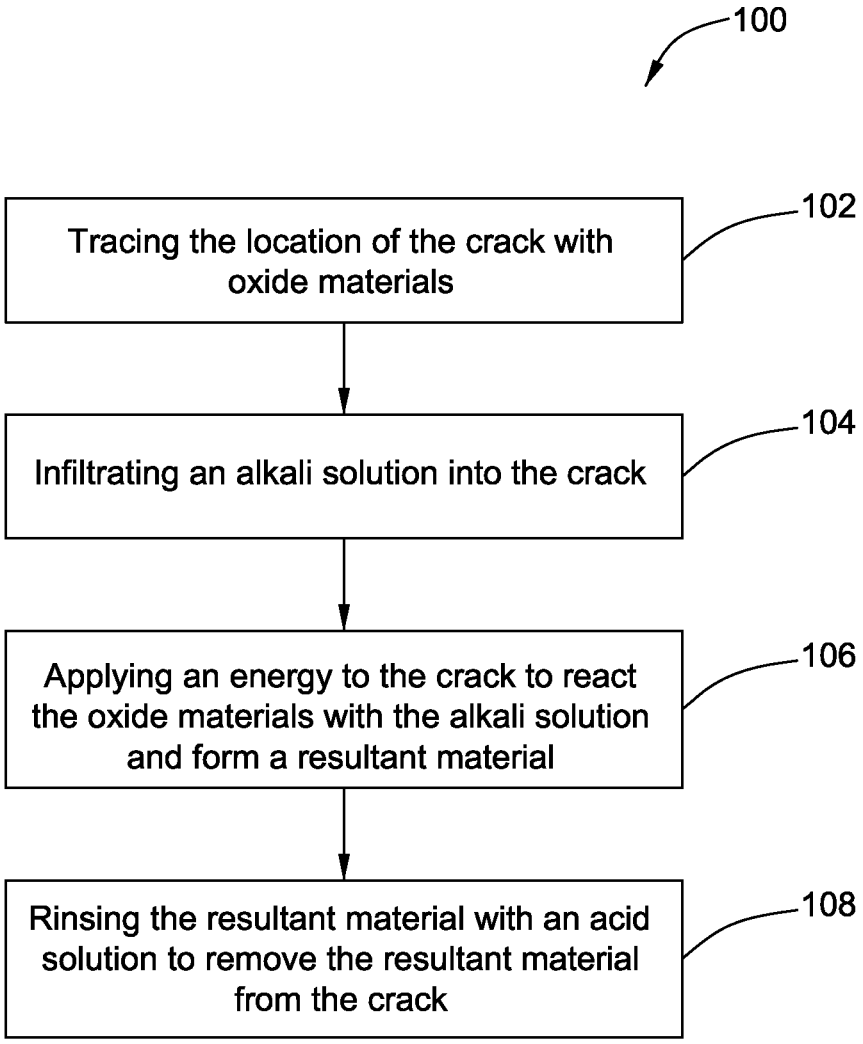
FIG. 1 is a flow diagram of a method for removing oxide materials from a crack in accordance with one embodiment of the present disclosure.

Unless defined otherwise, technical and scientific terms used herein have the same meaning as is commonly understood by one of skill in the art to which this invention belongs. The terms "a" and "an" do not denote a limitation of quantity, but rather denote the presence of at least one of the referenced items. Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. Additionally, when using an expression of "about a first value-a second value," the about is intended to modify both values. In at least some instances, the approximating language may correspond to the precision of an instrument for measuring the value. Here, and throughout the specification and claims, range limitations may be combined and/or interchanged, such ranges are identified and include all the sub-ranges contained therein unless context or language indicates otherwise. Moreover, the suffix "(s)" as used herein is usually intended to include both the singular and the plural of the term that it modifies, thereby including one or more of that term.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The present disclosure relates to a method for removing oxide materials from a crack of a metallic workpiece, comprising: infiltrating an alkali solution into the crack in a pressurized atmosphere or an ultrasonic environment; applying an energy to the crack to react the oxide materials with the alkali solution and form a resultant material; and rinsing the resultant material with an acid solution to remove the resultant material from the crack.

Usually, the metallic workpiece is made of an alloy, which is typically nickel-, cobalt-, or iron-based. Nickel- and cobalt-based alloys are favored for high-performance applications. The base element, i.e., nickel or cobalt, is the single greatest element in the alloy by weight. Illustrative nickel-base alloys include at least about 40 wt % Ni, and at least one component from the group consisting of cobalt, chromium, aluminum, tungsten, molybdenum, titanium, and iron. Examples of nickel-base alloys are designated by the trade names Inconel®, Nimonic®, and René®, and include equiaxed, directionally solidified and single crystal alloys. Illustrative cobalt-base alloys include at least about 30 wt % Co, and at least one component from the group consisting of nickel, chromium, aluminum, tungsten, molybdenum, titanium, and iron. Examples of cobalt-base alloys are designated by the trade names Haynes®, Nozzaloy®, Stellite® and Udimet®.

Usually the oxide material is a metallic oxide material. As used herein, "metallic" refers to materials which are primarily formed of metal or metal alloys, but which may also include some non-metallic components. Non-limiting examples of metallic materials are those which comprise at least one element selected from the group consisting of iron, cobalt, nickel, aluminum, chromium, titanium, and combinations which include any of the foregoing (e.g., stainless steel). The oxide material is generally meant to include the oxidized product or products of a crack of a metallic workpiece, such as turbine blade, and in some circumstances may also include peroxides. In most cases (but not always), the oxide materials are formed in the crack after the metallic workpiece has been exposed in air to the elevated temperatures mentioned above, i.e., about 760° C. to about 1150° C. As an example, the surface of a nickel-based substrate exposed in air to elevated temperatures for extended periods of time will be at least partially transformed into various metal oxides (depending on the substrate's specific composition), such as aluminum oxide, dichromium trioxide, nickel oxide, cobalt oxide, and titanium dioxide. Various spinels may be also formed, such as $Ni(Cr,Al)_2O_4$ spinels and $Co(Cr,Al)_2O_4$ spinels. Therefore, the oxide materials may comprise different materials depending upon the specific compositions of the metallic workpiece. In some embodiments, the oxide material comprises at least one of aluminum oxide, chromium oxide, cobalt oxide and nickel oxide.

The thickness of the oxide material depends on a variety of factors. These include the length of service time, the thermal history, and the particular composition of the metallic workpiece. Usually a layer of oxide material has a thickness in the range of about 0.5 micron to about 20 microns, and most often, in the range of about 1 micron to about 10 microns, which may sometimes fill a crack in a turbine blade trailing edge.

The alkali solution is an aqueous solution comprising a hydroxide of an alkali metal. The alkali metal comprises lithium, sodium, potassium, rubidium, cesium, and francium. Thus, the alkali solution may comprise a hydroxide of any of lithium, sodium, potassium, rubidium, cesium, and francium. Preferably, the alkali solution is an aqueous solution of potassium hydroxide or sodium hydroxide. In some embodiments, an aqueous solution of sodium hydroxide with a concentration in a range of 20 wt % to 40 wt % is used.

In some embodiments, the method may also comprise tracing the location of the crack before infiltrating the alkali solution into the crack. When the location of the crack is identified, the following procedures including infiltrating the alkali solution into the crack and applying the energy to the crack can be performed accurately. Usually, tracing the location of the crack can be realized by an online image recognition technology. For example, using an industrial camera to shoot the metallic workpiece and recognize the crack by a computer automatically.

The infiltration is carried out by immersing the metallic workpiece having a crack in an alkali solution, or injecting an alkali solution into the crack and some areas around the crack of the metallic workpiece. To infiltrate the alkali solution into the crack of a metallic workpiece more completely, the infiltration may be performed in a pressurized atmosphere or an ultrasonic environment. In some embodiments, the infiltration is performed in a pressurized atmosphere in a range of 2 atm to 5 atm. In some embodiments, the infiltration is performed with an ultrasonic horn towards the crack. The ultrasonic vibration produced by the ultrasonic horn will generate some bubbles in the alkali solution, which will enhance the penetration of alkali solution into the crack. In one embodiment of infiltration in an ultrasonic environment, the metallic workpiece's crack is applied with an ultrasonication having a power of 1000 W and a frequency of 20 KHz for 5 seconds in one cycle. It may take several cycles to complete the infiltration with 0.5 second pause between every two cycles.

The reaction between the oxide material and the alkali solution happens when an energy is applied to the location of the crack. Many methods can be employed to induce the reaction, including irradiating the crack using a laser beam, or raising the temperature of the crack.

In some embodiments, a laser beam is used to induce the reaction of the oxide material and the alkali solution. High intensity laser is capable to locally heat, melt and/or vaporize a material quickly. In addition, the laser beam could focus on a small spot and precisely scan along a complicated trajectory. The laser beam in one example is a continuous wave laser beam or a pulsed laser beam. The power of the laser beam is in a range of 20 W to 400 W. Usually the scan speed of the laser beam is around 1~10 mm/s. During the laser beam irradiation, the metallic workpiece is invulnerable.

In some embodiments, the reaction of the oxide material and the alkali solution happens in a heated condition. The heating temperature and time may vary, e.g., from about 300° C. to about 600° C., and from about 4 hours to about 8 hours, according to the ingredients of the oxide materials and the alkali solution. Various heating methods may be employed, such as locally heating the crack using a torch, and heating the metallic workpiece in a furnace.

The resultant material formed in the crack after the reaction of the oxide materials and the alkali solution can be removed by rinsing the resultant material with an acid solution. The acid solution may be a hydrogen chloride aqueous solution or may containing any other suitable acids with a concentration of 20 wt %~40 wt %. The rinsing or removing may be at the room temperature or above. Agitation may also be used to help the removing or rinsing, if needed. The removal of the resultant material is achieved by dissolving the resultant material in the acid solution, or, reacting the resultant material and the acid in the acid solution to form an reaction product firstly and dissolving the reaction product in the acid solution.

Therefore, when an oxide material is going to be removed from a crack of a metallic workpiece, the location of the crack is identified firstly, usually by online image recognition. Then an alkali solution is prepared and infiltrated into the crack to contact with the oxide materials in a pressurized atmosphere or an ultrasonic environment. Next, an energy (such as a laser beam or heat) is provided to the crack to induce a reaction between the oxide material in the crack and the alkali solution to form a dissolvable or removable resultant material. The resultant material then can be rinsed using an acid solution. Optionally, after rinsing with acid solution, the crack of the metallic workpiece is then rinsed with deionized water. Usually, it may take 1~10 cycles to clean all oxides in the crack.

FIG. 1 illustrates an exemplary embodiment of a method 100 for removing oxide materials from a crack of a turbine blade trailing edge. At step 102, the location of the crack with oxide materials is traced. At step 104, an alkali solution is infiltrated into the crack to contact with the oxide materials in a pressurized atmosphere or an ultrasonic environment. At step 106, an energy is applied to the crack to induce a reaction between the oxide materials in the crack and the alkali solution to form a dissolvable or removable resultant material. The energy is a laser beam or other heat sources, such as a torch or a furnace. At step 108, the resultant material is rinsed using an acid solution or using an acid solution followed by deionized water. In some circumstances, the tracing step 102 may be omitted.

During the whole cleaning process, no damage happens to the metallic workpiece. The reaction between the oxide material and the alkali solution may be the oxide "dissolving" or a "chemical reaction". In addition, the terms dissolving and chemical reaction are used interchangeably and are all meant to encompass the reaction that occurs between the alkali solution and the oxide material or between the resultant material and the acid solution.

While not wanting to be bound by the theory, for aluminum oxide or dichromium trioxide and sodium hydroxide, possible chemical reactions that could occur are as follows:

$$NaOH+Al_2O_3 \rightarrow NaAlO_2+H_2O;$$

$$NaOH+Cr_2O_3 \rightarrow NaCrO_2+H_2O.$$

Chemical reactions of the resultant material $NaAlO_2$ or $NaCrO_2$ with hydrogen chloride could occur as follows:

$$NaAlO_2+4HCl \rightarrow NaCl+AlCl_3+2H_2O;$$

$$NaCrO_2+4HCl \rightarrow NaCl+CrCl_3+2H_2O.$$

Advantageously, the present invention eliminates the drawbacks of aforementioned known methods. Comparing with FIC method, the present invention is non-hazardous and cost effective. Comparing with the method using slurry composition, the present invention employed aqueous solution, which is easier to penetrate into the inside of the cracks, in particular suitable for cleaning narrow and deep cracks.

EXAMPLES

The following examples are included to provide additional guidance to those of ordinary skill in the art in practicing the claimed invention. Accordingly, these examples do not limit the invention as defined in the appended claims.

The sample workpieces used in the following examples are nickel-based high temperature alloys whose product name is René®. The sample workpieces were oxidized to obtain a first oxidized sample workpiece and a second oxidized sample workpiece, which were tested in Example 1 and Example 2 respectively.

Example 1

The first oxidized sample workpiece included several cracks and each crack had a depth of 10 mm and a width of 1.0 mm. The treatment process of one crack of the first oxidized sample workpiece comprised: wetting the crack of the oxidized sample workpiece with a 40 wt % NaOH solution; applying an ultrasonic vibration to the crack to enhance the infiltration of the NaOH solution into the crack; applying a 300 W laser beam to the crack with a scan speed of 5 mm/s for 6 minutes to react the oxide materials and NaOH and form a resultant material; and, rinsing the resultant material with a 10 wt % HCl solution. The Energy dispersion spectroscopy (EDS) analysis results of the one crack before the treatment and after the treatment were shown in Table 1.

TABLE 1

| | Before treatment (wt %) | After treatment (wt %) |
|---|---|---|
| O | 30.07 | 3.90 |
| Al | 0.77 | |
| Ti | 4.18 | 1.26 |
| Cr | 59.72 | 10.80 |
| Co | | 24.47 |
| Ni | 2.98 | 59.58 |
| W | 2.27 | |
| Total | 100.0 | 100.0 |

As shown in Table 1, the weight percentage of oxygen was reduced greatly after the above treatment. Through microscope observation, the removing efficiency of oxide materials was more than 90%, that is, oxide materials were removed from over 90% regions of the crack.

Example 2

The second oxidized sample workpiece included several cracks and each crack had a depth of 10 mm and a width of 0.5 mm. The treatment process of one crack of the second oxidized sample workpiece comprised: wetting the crack of the oxidized sample workpiece with a 40 wt % NaOH solution; applying an ultrasonic vibration to the crack to enhance the infiltration of the NaOH solution into the crack; heating the second oxidized sample workpiece in an air furnace with a temperature of 400° C. for 2 hours to react the oxide materials and NaOH and form a resultant material; and, rinsing the resultant material with a 10 wt % HCl solution. The EDS analysis results of the one crack before the treatment and after the treatment were shown in Table 2.

TABLE 2

| | Before treatment (wt %) | After treatment (wt %) |
|---|---|---|
| O | 30.79 | 2.63 |
| Al | 0.86 | 0.77 |
| Ti | 9.84 | |
| Cr | 54.65 | 7.67 |
| Co | 1.51 | 21.55 |
| Ni | 2.34 | 59.18 |
| Mo | | 3.75 |
| W | | 4.46 |
| Total | 100.0 | 100.0 |

As shown in Table 2, the weight percentage of oxygen was reduced greatly after cleaning. Through microscope observation, the removing efficiency was more than 95%, that is, oxide materials were removed from over 95% regions of the crack.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for removing oxide materials from a crack of a metallic workpiece, comprising:

imaging the crack to identify a location of the crack;

infiltrating an alkali solution into the crack in an ultrasonic environment or a pressurized atmosphere having a pressure greater than 1 atm;

applying an energy to the crack via a laser directed at the crack based on the location from the imaging to react the oxide materials with the alkali solution and form a resultant material; and rinsing the resultant material with an acid solution to remove the resultant material from the crack.

2. The method of claim 1, wherein the alkali solution comprises a hydroxide of an alkali metal.

3. The method of claim 1, wherein the infiltrating uses the pressurized atmosphere, and wherein the pressurized atmosphere has a pressure in a range of 2 atm to 5 atm.

4. The method of claim 1, wherein imaging the crack comprises tracing the location of the crack.

5. The method of claim 4, wherein the tracing comprises using an image recognition technology to trace the location of the crack.

6. The method of claim 1, wherein the laser is a continuous wave laser or a pulsed laser.

7. The method of claim 1, wherein the laser has a power in a range of 20 W to 400 W.

8. The method of claim 1, wherein the acid solution is a diluted hydrogen chloride aqueous solution.

9. The method of claim 1, wherein the oxide materials comprise at least one of aluminum oxide, chromium oxide, cobalt oxide and nickel oxide.

10. The method of claim 1, wherein the metallic workpiece comprises a nickel-based alloy or a cobalt-based alloy.

11. The method of claim 1, wherein the infiltrating uses the ultrasonic environment, comprising applying ultrasonic vibration to the crack to enhance infiltration of the alkali solution into the crack.

12. The method of claim 11, wherein the applying ultrasonic vibration comprises generating bubbles in the alkali solution to enhance the infiltration of the alkali solution into the crack.

13. The method of claim 1, wherein the metallic workpiece comprises a component of a gas turbine engine.

14. The method of claim 13, wherein the component comprises a turbine blade.

15. The method of claim 14, wherein the crack is disposed along a trailing edge of the turbine blade.

* * * * *